United States Patent [19]

Childers et al.

[11] Patent Number: 4,558,754

[45] **Date of Patent: * Dec. 17, 1985**

[54] DRILL BIT HAVING ANGLED NOZZLES

[75] Inventors: John S. Childers, Greenville; Paul E. Pastusek, Houston, both of Tex.

[73] Assignee: Reed Rock Bit Company, Houston, Tex.

[ * ] Notice: The portion of the term of this patent subsequent to May 14, 2002 has been disclaimed.

[21] Appl. No.: 573,245

[22] Filed: Jan. 23, 1984

Related U.S. Application Data

[63] Continuation-in-part of Ser. No. 437,927, Nov. 1, 1982, Pat. No. 4,516,642, which is a continuation-in-part of Ser. No. 132,950, Mar. 24, 1980, abandoned.

[51] Int. Cl.[4] ..... E21B 10/18

[52] U.S. Cl. ..... 175/340

[58] Field of Search ..... 175/340, 339, 67

[56] References Cited

U.S. PATENT DOCUMENTS

| | | | |
|---|---|---|---|
| 1,922,436 | 8/1933 | Herrington | 175/340 |
| 2,098,758 | 11/1937 | Reed | 175/340 |
| 2,815,936 | 12/1957 | Peter et al. | 175/340 |
| 3,984,158 | 10/1976 | Sorensen et al. | 308/8.2 |
| 4,106,577 | 8/1978 | Summers | 175/340 |
| 4,222,447 | 9/1980 | Cholet | 175/340 |
| 4,239,087 | 12/1980 | Caster et al. | 175/340 |

FOREIGN PATENT DOCUMENTS 1104310 2/1968 United Kingdom .

*Primary Examiner*—James A. Leppink
*Assistant Examiner*—Hoang C. Dang
*Attorney, Agent, or Firm*—Carl A. Rowold

[57] ABSTRACT

A rotary drill bit comprising a bit body adapted to be secured to a drill string and to receive drilling fluid under pressure therefrom, the body having a plurality of nozzles for exit of the drilling fluid, and a plurality of depending legs at its lower end. The bit further includes a plurality of roller cutters, one for each leg, each cutter comprising a generally conical cutter body rotatably mounted on the respective leg, and a plurality of cutting elements thereon. The cutter body at its conical surface is formed of a material resistant to erosion by high drilling fluid which may impinge it. Each nozzle directs the drilling fluid to flow in a stream generally toward the cutter body of an adjacent roller cutter, with the stream impinging at least one cutting element on the cutter body and thereafter impinging a portion of the bottom of the well bore forward of the bottom of the adjacent roller cutter, whereby the drilling fluid sequentially impinges and cleans first cutting elements and then portions of the well bore bottom immediately prior to their engagement for enhanced drill bit cutting action.

20 Claims, 5 Drawing Figures

DRILL BIT HAVING ANGLED NOZZLES

CROSS-REFERENCE TO OTHER APPLICATIONS

This is a continuation-in-part of U.S. patent application Ser. No. 437,927, filed Nov. 1, 1982, now U.S. Pat. No. 4,516,642 which is a continuation-in-part of U.S. patent application Ser. No. 132,950, filed Mar. 24, 1980, now abandoned.

BACKGROUND OF THE INVENTION

This invention relates to rotary drill bits for drilling oil wells and the like, and more particularly to rotary drill bits used in conjunction with the drilling fluid circulation system of a rotary drill rig.

This invention involves an improvement over rotary drill bits of the type, such as that shown, for example, in U.S. Pat. Nos. 3,984,158 and 4,106,577, British Pat. No. 1,104,310 and FIG. 5 of this application, comprising a bit body having an upper portion adapted to be detachably secured to a drill string for rotating the bit, a chamber therein receiving drilling fluid under pressure from the drill string, and three depending legs each having an inwardly extending bearing journal. The bit further includes a roller cutter rotatably mounted on each bearing journal and three nozzles extending down between sets of adjacent roller cutters. The drill bit is used in conjunction with the drill fluid circulation system of a drill rig, with the drilling fluid being pumped down through the passage in the drill pipe to the chamber in the drill bit, exiting the drill bit via the nozzles, and flowing back up to the surface in the annulus around the drill pipe. The nozzles direct the drilling fluid as a high velocity stream against the bottom of the well bore to clean it, with the splash back of the drilling fluid from the bottom of the well bore impinging the roller cutters to provide limited cleaning action of the cutters. Drilling debris and cuttings from the bottom of the well bore are entrained in and are carried away from the bottom by the drilling fluid as it flows up the annulus.

While the above-described conventional drill bits have been satisfactory for drilling relatively brittle formations, they do not provide satisfactory rates of penetration when drilling relatively plastically deformable formations. Many commonly encountered formations such as slates, shales, limestones, sandstones and chalks, become plastically deformable under so-called differential pressure conditions, which occur when the hydrostatic pressure of the column of drill fluid bearing on the bottom of the well bore exceeds of the pressure of the formation surrounding the bore, as may happen in deep hole drilling. Whereas, brittle formations crack or fracture under the compressive loads applied by the cutting elements of a drill bit, plastic formations tend to deform and thus remain intact under such loads. In addition, certain of these plastic formations tend to form a relatively thick coating of drilling debris on the roller cutter which can result in so-called "bit-balling" and limited penetration of the formation by the cutting elements.

As shown in U.S. Pat. No. 4,106,577 and British Pat. No. 1,104,310, attempts have been made to increase the rate of penetration in plastic foundations by using extended nozzles for improving the cleaning action of the fluid circulation system. While this nozzle arrangement may offer some measure of improved cleaning action, it is still not satisfactory for many types of plastic formations. Moreover, in this arrangement, the nozzles extend down to points closely adjacent to the bottom of the well bore, and thus are subject to damage by irregularities, such as projections or ridges, on the bottom of the well bore, which may form from time to time during drilling operations.

SUMMARY OF THE INVENTION

Among the several objectives of this invention may be noted the provision of a rotary drill bit having improved hydraulic cleaning action and increased rates of drilling penetration in relatively plastically deformable formations; the provision of such a drill bit which so directs streams of high velocity drilling fluid toward the roller cutters that the streams sequentially impinge and clean first cutting elements on the roller cutters and then the well bore bottom; the provision of such a drill bit which cleans the cutting elements on the roller cutters while they are out of engagement with the bottom of the well bore; the provision of such a drill bit which cleans portions of the bottom of the well bore when uncovered by the roller cutters for effective cleaning of the well bore bottom by the drilling fluid so as to present clean formation to the cutting elements for being engaged thereby; and the provision of such a drill bit having nozzles spaced well above the bottom of the well bore so as to prevent breakage of the nozzles.

In general, the drill bit of this invention comprises a bit body having a threaded pin at its upper end adapted to be detachably secured to a drill string for rotating the bit, a chamber therein adapted to receive drilling fluid under pressure from the drill string, a plurality of depending legs at its lower end, each leg being spaced from the other legs and having an inwardly extending, generally cylindrical bearing journal at its lower end, and a plurality of nozzles in flow communication with the chamber for exit of the drilling fluid from the bit body. A plurality of roller cutters are rotatably mounted on the bearing journals, one roller cutter for each bearing journal, each roller cutter comprising a generally conical cutter body and a plurality of cutting elements on the body. The cutter body at least for a portion of its conical surface is formed of material resistant to erosion by high velocity drilling fluid which may impinge it. Each of said nozzles directs the drilling fluid downwardly in a stream flowing generally toward the cutter body of the adjacent roller cutter impinging at least one cutting element on the cutter body, and thereafter impinging a portion of the bottom of the well bore forward, with respect to the direction of rotation of the bit, of the bottom of the adjacent roller cutter, whereby during use of the drill bit the drilling fluid sequentially impinges and cleans first at least some of the cutting elements and then portions of the well bore bottom immediately prior to the engagement of the portions of the well bore bottom by the cutting elements for enhanced drill bit cutting action.

The nozzles have passaging therein for directing the drilling fluid under pressure generally toward the adjacent cutter body in the above-described manner. The portions of the formation and the cutting elements impinged by the stream directed by the passaging are thus subjected to separate cleaning actions immediately prior to their engagement for presenting clean engagement surfaces to enhance the drill bit cutting action.

Further, the stream is so angled and positioned relative to the adjacent roller cutter that as it rotates cutting elements thereon enter the stream for being cleaned thereby, with each of the cutting elements exiting the stream immediately prior to its engagement with the formation, and with the stream after flowing past the cutting elements impinging the formation at the bottom of the well bore.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
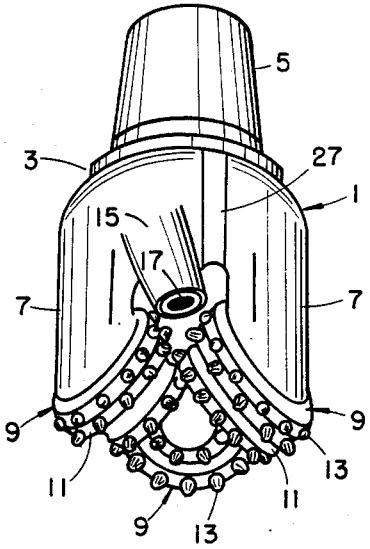
FIG. 1 is a side elevation of a first embodiment of a drill bit of this invention.

Referring to FIG. 1, there is generally indicated at 1, a first embodiment of a drill bit of this invention used in conjunction with the drilling fluid circulation system of a rotary drill rig (not shown) for drilling well bores in the earth. The bit comprises a bit body 3 having, a threaded pin 5 at its upper end, adapted to be threaded in a drill string, which serves to rotate the bit, and a chamber therein (not shown) for receiving drilling fluid under pressure from the passage of the drill string. At its lower end, the bit body has a plurality of depending legs 7, (e.g., three legs) each leg being spaced from the other legs and having an inwardly and downwardly extending, generally cylindrical bearing journal at its lower end. Roller cutters 9 are rotatably mounted on the bearing journals, each roller cutter 9 comprising a generally conical cutter body 11 having a recess in the base thereof receiving the respective bearing journal and a plurality of cutting elements 13 on the conical surface of the body. The cutting elements are arranged in annular rows around the cutter body, as shown in FIG. 1, and comprise so-called "inserts" of a hard metallic material, such as tungsten carbide. The inserts are relatively elongate members and are mounted on the cutter body by pressing base portions of the inserts in holes in the cutter body in an interference fit, with a portion thereof projecting outwardly from the cutter body. The projecting portions of the inserts are adapted to bear on the bottom 14 of the well bore for drilling the formation.

Figure 2:
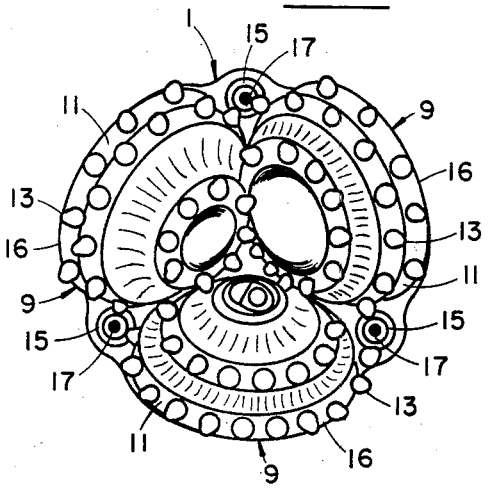
FIG. 2 is a bottom plan of FIG. 1 showing nozzles between adjacent roller cutters of the drill bit.
Figure 3:
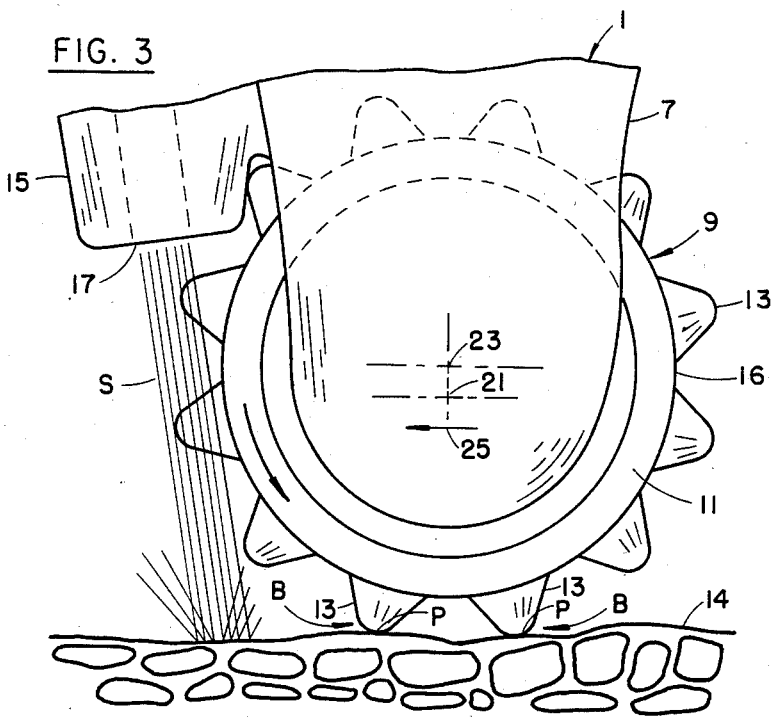
FIG. 3 is an enlarged partial side elevation of the drill bit on the bottom of a well bore showing a nozzle directing drilling fluid past an adjacent roller cutter and against the well bore bottom.

As shown in FIGS. 1–3, the drill bit further comprises a plurality of elongate nozzles 15, (e.g., three nozzles) in the bit body having passaging in flow communication with the chamber in the bit body and opening to orifices 17 toward the bottom of the bit body 3. The nozzles extend down from the bit body generally between sets of adjacent pairs of roller cutters 9, and enable exit of the drilling fluid under pressure from the chamber. In accordance with this invention, these nozzle orifices 17 are positioned below the top of the adjacent roller cutters but above the inclined central axis of the adjacent bearing journal at both ends thereof (i.e., above the centerline of the journal at the inner end thereof designated at 21 in FIG. 3 and at the outer end thereof designated at 23). Being so positioned, the elongate nozzles 15 are spaced well above the well bore bottom 14 and thus are protected against being engaged and damaged by irregularities, such as ridges or projections, on the bottom 14 as the bit rotates.

In addition, the nozzles 15 are so angled relative to the bit body 3 and roller cutters 9 that the nozzle passaging directs the drilling fluid under pressure to exit downwardly and in the direction opposite to the direction of rotation of the bit, indicated by arrow 25 in FIG. 3. As best illustrated in FIG. 3, the fluid flows in a high velocity stream, designated S, angled relative to the longitudinal axis of the bit, which is parallel to the weld seam 27, and generally toward the underside of the adjacent roller cutter (i.e., the half of the roller cutter below its longitudinal axis or axis of rotation) along a line generally tangent to the cutter body 11 of the adjacent roller cutter. As the fluid flows past the cutters 9, it impinges inserts 13 of the gage row of inserts and the row adjacent thereto. Being formed of tungsten carbide material having a high erosion resistance, the inserts are not subject to significant erosion due to the stream of high velocity drilling fluid. While the streams is shown in FIG. 3 as being tangent to the cutter body, it is contemplated that the stream may be spaced a short distance (e.g., one-quarter inch) from the body and extend along a line generally parallel to a tangent thereto. In addition, it is contemplated that the stream of drilling fluids may be so directed as to slightly impinge the roller cutter body. Such impingement likely offers improved cleaning action of the roller cutter body, but reduced cleaning action of the cutting elements, as compared to directing the stream solely against the cutting elements.

The roller cutter body is thus subjected to being impinged by the high-velocity drilling fluid both directly, as described above, and indirectly. Indirect impingement results from splashing of the stream of high-velocity drilling fluid when it impinges the cutting elements. To withstand the erosion effects of being impinged by the high-velocity drilling fluid, the roller cutter body is preferably formed at least over a portion of its conical outer surface 16 of a suitable erosion resistant material, such as a tungsten carbide material. This material may be applied as a coating to the conical surface of a steel roller cutter body by conventional coating application processes, such as flame powder, flame wire, plasma or detonation thermal spraying processes. In addition, a composite material of tungsten carbide pellets and steel powder may be applied to the roller body by using a torch to melt the steel, the molten steel bonding the tungsten carbide to the roller cutter body when the steel cools to form an erosion resistant coating on the cutter body. Alternatively, the roller cutter could be formed of tungsten carbide at its outer surface such as shown in U.S. Pat. Nos. 4,276,788 and 4,368,788. It is also contemplated that the erosion resistant materials may be other than a hard metal. For example, it may be a suitable elastomeric material; e.g., a nitrile rubber, applied as a coating to the roller cutter body.

After flowing past the roller cutter 9, the stream S of drilling fluid impinges portions of the bottom 14 of the well bore closely adjacent to, but spaced apart from (i.e., ahead or forward with respect to the direction of rotation 25 of the drill bit) all of the points, designated P in FIG. 3, of engagement of the inserts of the adjacent roller cutter with the bottom of the bore. Preferably, the stream S after flowing past the cutting elements, then directly impinges the well bore bottom. However, it is also contemplated that the stream S may, at least to some extent, indirectly impinge the well bore bottom, by first impinging the side wall of the well bore and then impinging the well bore bottom. The inserts in engagement with the well bore bottom at any point in time may be considered to be the bottom, designated generally at B in FIG. 3, of the roller cutter. The stream S thus engages portions of the well bore bottom forward, with respect to the direction of rotation of the bit, of the bottom of the adjacent roller cutter. The portions of the well bore bottom impinged by the stream of drilling fluid are cleaned by the high velocity fluid, thereby exposing a clean or virgin surface at the bottom 14 prior to its engagement by an insert 13. While the portions of the well bore bottom impinged by the stream S are closely adjacent to the bottom B of the roller cutter, it is important to note that they are not covered by the roller cutter body. By being uncovered, these portions may be directly impinged by the stream. In addition, any cuttings on these portions may be washed away free of any flow restriction by the roller cutter. Moreover, by being closely adjacent the bottom of the roller cutter, the cleaned portions of the well bore bottom remain substantially free of cuttings, which tend to redeposit on the well bore bottom. Thus, portions of the well bore bottom are subject to the most effective cleaning action, and remain clean until engaged by the cutting elements.

It will be observed from the foregoing, that by so directing the stream S of drilling fluid both outer rows of inserts 13, as well as, portions of the well bore bottom 14 are cleaned by the drilling fluid immediately prior to the engagement of these portions of the well bore bottom by the inserts. Moreover as observed from FIG. 3, the passaging in the nozzles 15 directs the drilling fluid under pressure to flow in a stream S so angled and positioned relative to one of the roller cutters that as this roller cutter rotates cutting elements 13 thereon enter the stream for being cleaned thereby and then exit the stream prior to engaging the formation, with the stream after flowing past the cutting elements impinging the formation at the bottom of the well bore, whereby the formation and all of the cutting elements impinged by the stream are subjected to separate, sequential cleaning actions immediately prior to their engagement for presenting clean engagement surfaces. These separate, sequential cutting actions have been found to result in enhanced drill bit cutting action and increased rates of penetration, particularly in drilling relatively plastically deformable formations.

Figure 5:
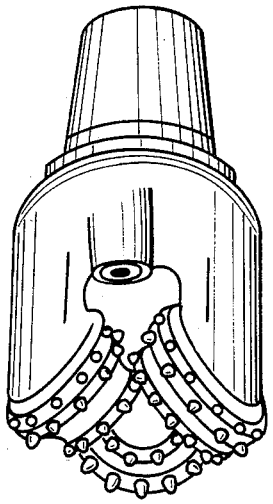
FIG. 5 PRIOR ART
FIG. 5 is a side elevation of a prior art drill bit.

Thus, the drill bit 1 of this invention represents an improvement over conventional drill bits of the type, such as shown in FIG. 5, in which the nozzles extend generally vertically and centrally down between adjacent roller cutters. Being so angled, these nozzles direct the drilling fluid so as not to impinge the roller cutter, but rather, only to impinge the formation at areas substantially forward of the roller cutter. As indicated previously, cuttings flushed from the well bore bottom tend to redeposit thereon. Because of the relatively long distance between the portion of the well bore bottom cleaned by the stream of the drilling fluid at any point in time and the bottom of the roller cutter, a layer of cuttings may be redeposited on the cleaned portion of the well bore bottom before being engaged by the roller cutter. Such a layer of cuttings would reduce the rate of penetration of the drill bit. The drill bit 1 also represents an improvement over drill bits of the type, such as shown in U.S. Pat. No. 4,106,577 and British Pat. No. 1,104,310, in which the nozzles direct the drilling fluid so as to simultaneously engage the cutting elements of the roller cutter and the bottom of the well bore (i.e., engage the cutting elements only at their points of engagement with formation).

In the manufacture of the first embodiment of the drill bit, the bit body 3 is formed from three so-called "lugs". Each lug is of one-piece forged construction, having an integrally formed bearing journal, leg 7, and elongate nozzle 15. The lugs are secured together in side-by-side relation as by welding along weld seams 27 to form a complete bit body.

Figure 4:
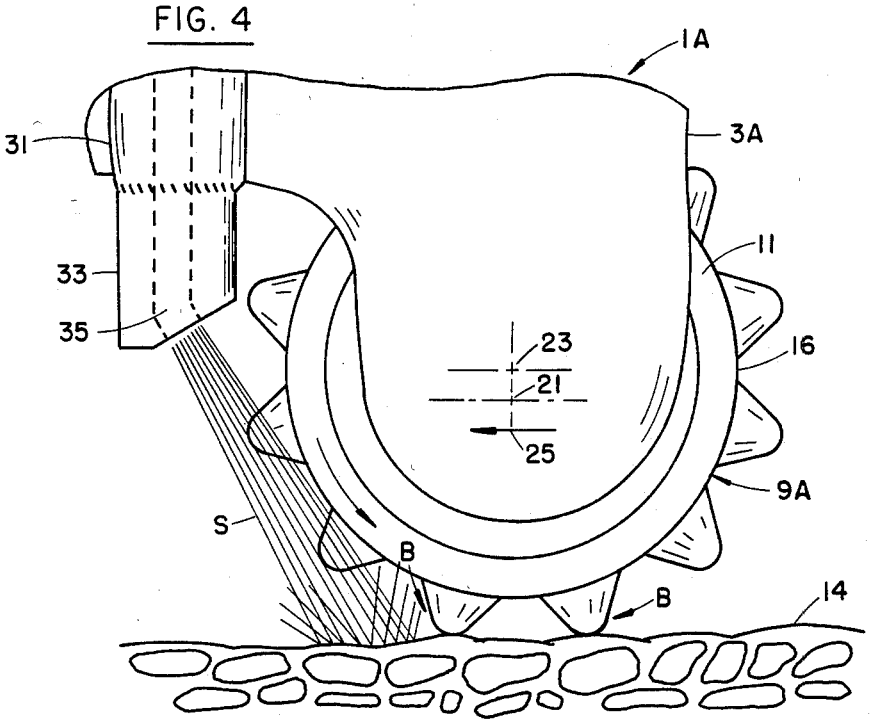
FIG. 4 is a view similar to FIG. 3 of a second embodiment of a drill bit of this invention.

FIG. 4 illustrates a second embodiment the drill bit of this invention generally indicated at 1A which is similar to the first embodiment 1 except that the bit body 3A is formed of conventional lugs having relatively short integrally formed nozzles 31. A tubular member 33 having passaging 35 therein, which at one end thereof is in alignment with that in the nozzle 31 and which at the other end thereof directs the fluid to flow generally tangent to an adjacent roller cutter 9A, is welded to the underside of the bit body 3A at each nozzle 31.

While the roller cutter 9, 9A has been shown in the drawings and described above as comprising a roller cutter body and separate cutting elements mounted thereon, it is contemplated that the roller cutter could be of one-piece construction having integrally formed cutting elements, such as the roller cutter shown in U.S. Pat. No. 4,368,788.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary drill bit for drilling a well bore, the bit comprising:

a bit body having a threaded pin at its upper end adapted to be detachably secured to a drill string for rotating the bit and delivering drilling fluid under pressure to the bit, a plurality of depending legs at its lower end, each leg being spaced from the other legs, and a plurality of nozzles for exit of the drilling fluid from the bit body; and a plurality of roller cutters, one for each leg, each roller cutter comprising a generally conical cutter body rotatably mounted on the respective leg and a plurality of cutting elements on the cutter body, the cutter body at least for a portion of its conical surface being formed of a material resistant to erosion by high velocity drilling fluid which may impinge it;

each of said nozzles having passaging therein directing the drilling fluid under pressure to exit the bit body in a stream angled relative to the longitudinal axis of the drill bit and flowing generally toward the underside of the cutter body of an adjacent roller cutter constituted by the half of the roller cutter below its axis of rotation, impinging at least one cutting element on the cutter body, and thereafter impinging a portion of the bottom of the well bore forward, with respect to the direction of rotation of the bit, of the bottom of the adjacent roller cutter, whereby during use of the drill bit the drilling fluid sequentially impinges and cleans the cutting elements and then portions of the well bore bottom immediately prior to the engagement of said portions of the well bore bottom by the cutting elements for enhanced drill bit cutting action.

2. A drill bit as set forth in claim 1 wherein said cutting elements are generally elongate members of tungsten carbide material and are mounted on the roller cutter body with a portion thereof projecting outwardly beyond the generally conical surface of the roller cutter body.

3. A drill bit as set forth in claim 1 wherein the cutting elements of each roller cutter are arranged in annular rows around the cutter body, the stream of drilling fluid from each nozzle impinging cutting elements of at least one of the outer rows of cutting elements of the respective roller cutter.

4. A drill bit as set forth in claim 1 wherein each nozzle comprises a tubular member depending from the underside of the bit body.

5. A drill bit as set forth in claim 4 wherein said legs are spaced at equal intervals around the periphery of the bit body, and one of said nozzles extends down between each pair of adjacent legs.

6. A drill bit as set forth in claim 5 wherein the bit body further comprises a plurality of lugs, each of one-piece construction and each having one of said legs and one of said nozzles integrally formed therein, the lugs being secured together in side-by-side relation to from the bit body.

7. A drill bit as set forth in claim 6 wherein the nozzle is a generally tubular member formed on the side of the bit body, the tubular member extending down and in the direction opposite the direction of rotation of the bit.

8. A drill bit as set forth in claim 1 wherein said material at the conical surface of the roller cutter body is a metal carbide.

9. A drill bit as set forth in claim 8 wherein said material is tungsten carbide.

10. A drill bit as set forth in claim 1 wherein said material at the conical surface of the roller cutter body is an elastomer.

11. A drill bit as set forth in claim 1 wherein said material is nitrile.

12. A rotary drill bit for drilling a well bore, the bit comprising;

a bit body adapted to be detachably secured to a drill string for rotating the bit and to receive drilling fluid under pressure from the drill string, the bit body having a plurality of spaced apart, depending legs at its lower end, and a plurality of nozzles, for exit of the drilling fluid from the bit body; and a plurality of roller cutters, one for each of said legs, rotatably secured to the legs at the lower end thereof, each roller cutter comprising a generally frustoconical cutter body and a plurality of hard metallic cutting elements on the cutter body the cutter body at least for a portion of its conical surface being formed of a material resistant to erosion by high velocity drilling fluid which may impinge it;

each of said nozzles having passaging therein directing the drilling fluid under pressure to flow downwardly in a stream angled relative to the longitudinal axis of the drill bit and flowing generally toward the underside of the cutter body of one of said roller cutters, constituted by the half of the roller cutter below its axis of rotation, the drilling fluid impinging at least one of the cutting elements on the roller cutter and thereafter impinging a portion of the formation at the bottom of the well bore spaced from the bottom of the roller cutter, whereby the cutting elements impinged by the stream and the well bore bottom are subjected to separate, sequential cleaning actions immediately prior to their engagement for presenting clean engagement surfaces to enhance the drill bit cutting action.

13. A rotary drill bit as set forth in claim 12 wherein the stream of drilling fluid from each nozzle flows along a line generally tangent to the cutter body of the respective roller cutter.

14. A rotary drill bit as set forth in claim 12 wherein the stream of drilling fluid from each nozzle flows in a direction generally opposite to the direction of rotation of the drill bit.

15. A rotary drill bit as set forth in claim 12 wherein the stream of drilling fluid from each nozzle impinges portions of the formation at the bottom of the well bore closely adjacent to, but spaced apart from the points of engagement of the cutting elements of the roller cutter with the formation.

16. A rotary drill bit as set forth in claim 12 wherein the cutting elements of each roller cutter are arranged in annular rows around the cutter body, the stream of drilling fluid from each nozzle impinging cutting elements of at least one of the outer rows of cutting elements of the respective roller cutter.

17. A rotary drill bit for drilling a well bore, the bit comprising:

a bit body adapted to be detachably secured to a drill string for rotating the bit and to receive drilling fluid under pressure from the drill string, the bit body having a plurality of spaced apart, depending legs at its lower end, and a nozzle for exit of the drilling fluid from the bit body; and a plurality of roller cutters, one for each of said legs, rotatably mounted on the legs at the lower end thereof, each roller cutter comprising a generally frustoconical cutter body and a plurality of hard metallic cutting elements on the cutter body, the cutter body at least for a portion of its conical surface being formed of a material resistant to erosion by high velocity drilling fluid which may impinge it;

the nozzle having passaging therein directing the drilling fluid under pressure to flow downwardly in a stream angled relative to the longitudinal axis of the drill bit and flowing generally toward the underside of one of said roller cutters, constituted by the half of the roller cutter below its axis of rotation, with the stream being so angled and positioned relative to said one roller cutter that as said one roller cutter rotates cutting elements thereon enter the stream for being cleaned thereby with each of the cutting elements exiting the stream prior to engaging the formation at the well bore bottom, and with the stream after flowing past the cutting elements impinging the formation at the bottom of the well bore, whereby the cutting elements impinged by the stream and the formation at the well bore bottom are subjected to separate, sequential cleaning actions immediately prior to their engagement for presenting clean engagement surfaces to enhance the drill bit cutting action.

18. A rotary drill bit for drilling a well bore, the bit comprising:

a bit body adapted to be detachably secured to a drill string for rotating the bit and delivering drilling fluid under pressure to the bit, a depending leg, and a nozzle for exit of the drilling fluid from the bit body; and a roller cutter comprising a generally conical cutter body rotatably mounted on the leg and a plurality of cutting elements on the cutter body;

the nozzle having passaging therein directing the drilling fluid under pressure to exit the bit body in a stream angled relative to the longitudinal axis of the drill bit and flowing generally toward the underside of the roller cutter, constituted by the half of the roller cutter below its axis of rotation, impinging at least one cutting element on the cutter body, and thereafter impinging a portion of the bottom of the well bore forward, with respect to the direction of rotation of the bit, of the bottom of the roller cutter, whereby during use of the drill bit the drilling fluid sequentially impinges and cleans cutting elements and then portions of the well bore bottom immediately prior to the engagement of said portions of the well bore bottom by the impinged cutting elements for enhanced drill bit cutting action.

19. A rotary drill bit for drilling a well bore, the bit comprising;

a bit body adapted to be detachably secured to a drill string for rotating the bit and to receive drilling fluid under pressure from the drill string, the bit body having a depending leg at its lower end, and a nozzle for exit of the drilling fluid from the bit body; and a roller cutter rotatably secured to the leg at the lower end thereof comprising a generally frustoconical cutter body and a plurality of hard metallic cutting elements on the cutter body;

said nozzle having passaging therein directing the drilling fluid under pressure to flow downwardly in a stream angled relative to the longitudinal axis of the drill bit and generally toward the underside of said roller cutter, constituted by the half of the roller cutter below its axis of rotation, the drilling fluid impinging cutting elements on the roller cutter and thereafter impinging portions of the formation at the bottom of the well bore spaced from the bottom of the roller cutter, whereby all of the cutting elements impinged by the stream and the well bore bottom are subjected to separate, sequential cleaning actions immediately prior to their engagement for presenting clean engagement surfaces to enhance the drill bit cutting action.

20. A rotary drill bit for drilling a well bore, the bit comprising:

a bit body adapted to be detachably secured to a drill string for rotating the bit and to receive drilling fluid under pressure from the drill string, the bit body having a depending leg at its lower end, and a nozzle for exit of the drilling fluid from the bit body; and a roller cutter rotatably mounted on the leg at the lower end thereof comprising a generally frustoconical cutter body and a plurality of hard metallic cutting elements on the cutter body;

the nozzle having passaging therein directing the drilling fluid under pressure to flow downwardly in a stream angled relative to the longitudinal axis of the drill bit and generally toward the underside of the roller cutter, constituted by the half of the roller cutter below its axis of rotation, with the stream being so angled and positioned relative to the roller cutter that as the roller cutter rotates cutting elements thereon enter the stream for being cleaned thereby with each of the cutting elements exiting the stream prior to engaging the formation at the well bore bottom, and with the stream after flowing past the cutting elements impinging the formation at the bottom of the well bore, whereby the cutting elements impinged by the stream and the formation at the well bore bottom are subjected to separate, sequential cleaning actions immediately prior to their engagement for presenting clean engagement surfaces to enhance the drill bit cutting action.

* * * * *